US005162624A

United States Patent [19]

Duksa

[11] Patent Number: 5,162,624

[45] Date of Patent: Nov. 10, 1992

[54] FLOW SWITCH

[76] Inventor: Thomas R. Duksa, 343 East St., Wolcott, Conn. 06716

[21] Appl. No.: 776,597

[22] Filed: Oct. 11, 1991

[51] Int. Cl.[5] ..... H01H 35/38

[52] U.S. Cl. ..... 200/81.9 M; 73/861.47; 137/512.1; 137/554; 200/82 E; 340/611

[58] Field of Search ..... 91/1; 92/5 R; 340/606, 340/610, 611; 307/118; 73/861.44, 861.47, 861.62, 745; 137/554, 551, 512.1, 522, 523; 335/205-207; 200/81.9 R, 81.9 M, 82 E, 81.4, 81.5, 83 Q

[56] References Cited

U.S. PATENT DOCUMENTS 3,327,079 6/1967 Widl ..... 200/82 E
5,055,641 10/1991 Richards ..... 200/8.19 M
4,166,936 9/1979 Tice ..... 200/82 E
4,365,125 12/1982 Keller ..... 200/81.9 M
4,377,090 3/1983 Seulen ..... 73/861.74
4,499,347 2/1985 Richards ..... 200/81.9 M
4,533,802 8/1985 Spalding ..... 200/81.9 R

*Primary Examiner*—Gerald P. Tolin
*Attorney, Agent, or Firm*—Chilton, Alix & Van Kirk

[57] ABSTRACT

A fluid flow rate responsive signal generator includes moveable members which, in part, define a pair of paths for the flow of fluid. A first of the moveable members is a shuttle which supports a magnetic field generator, the shuttle being displaced toward a proximity switch in response to fluid flow. The second moveable member functions as a valve which, when in the open condition, allows flow to bypass the flow path in which the shuttle is disposed. The bypass flow path control valve member will be automatically positioned as a function of the dynamic flow conditions and may be either normally closed or prepositioned to define a minimum bypass flow path area.

16 Claims, 5 Drawing Sheets

FLOW SWITCH

BACKGROUND OF THE INVENTION

1. Field of the Invention

The present invention relates to providing an indication of the rate of flow of a fluid and particularly to the generation of a signal commensurate with a liquid flow rate in excess of a predetermined minimum. More specifically, this invention is directed to a flow detector and especially to an electrical device which will change state in response to a preselected rate of flow of a fluid in a conduit. Accordingly, the general objects of the present invention are to provide novel and improved methods and apparatus of such character.

2. Brief Description of the Prior Art

Devices for producing an electrical signal which is commensurate with a preselected rate of flow of a fluid in a conduit are well known in the art and have utility in many diverse applications. For example, flow responsive devices for producing a control signal which is used to de-energize a pump when the flow rate falls below a preselected minimum are commonly employed in systems for transferring fluid between reservoirs. Examples of prior art flow responsive electrical signal generators are shown in U.S. Pat. Nos. 2,600,309; 3,140,606; 3,188,421; 3,559,197; and 3,857,277.

The prior art devices for generating an electrical signal in response to a rate of fluid flow have had one or more deficiencies. A principal one of these deficiencies has been a lack of versatility. Thus, the prior art devices were typically designed for use in a conduit of a single size and the "setpoint", i.e., the flow rate at which the device would change state and thus generate an information bearing signal, could not be varied. In the past, accordingly, a small pipe size flow detector would be used for low setpoints and, if the maximum flow rate which was expected was larger than the flow detector could handle, a larger device with an accordingly higher setpoint would be used. This, however, often produced the result that the setpoint of the larger flow detector could not be adjusted downwardly so as to enable the device to function properly in the smaller size conduit.

A further disadvantage of many prior art flow responsive signal generators resided in their susceptibility to contamination and particularly to sticking because of an accumulation, on a component of the device, of particulate matter entrained in the fluid flowing through the conduit in which the device was installed. The problem of faulty operation due to contamination has been particularly prevalent in flow detectors of the type where the entire flow in the conduit travels through the passage in which a moveable flow responsive element of the device is located.

Yet a further common problem with prior art flow responsive devices has resided in the fact that they have typically not been capable of adjustment in the field to permit "fine turning" to the actual flow conditions experienced.

Many prior art flow responsive signal generators have also unduly restricted flow in the conduit in which they have been installed, particularly when the flow rate is in excess of a minimum level of interest.

SUMMARY OF THE INVENTION

The present invention overcomes the above briefly discussed and other deficiencies and disadvantages of the prior art by providing a novel and improved technique for providing an electrical signal commensurate with a rate of fluid flow in a conduit. The present invention also encompasses a sensor device for implementing this novel method.

A device in accordance with a preferred embodiment of the invention defines normal and bypass paths for flow. A spring biased shuttle is supported in the main flow path and is movable in response to the flowing fluid, the degree of movement being a function of the rate of flow. A magnetic field generator is carried by the shuttle and cooperates with a magnetic field responsive signal generator which is supported in the device at a location where it is not exposed to the flowing fluid. The bypass path, in a first embodiment, is provided with a normally closed valve which will open when the pressure drop in the main flow path exceeds a level commensurate with a flow rate in excess of that for which the device has been designed.

In order to permit field adjustment of the rate of flow at which the shuttle displacement will be sufficient to cause the field responsive device to generate a signal, in a second embodiment of the invention, an adjustable flow path defining member may be provided to divert a selected minimum flow to the bypass path before the shuttle is displaced sufficiently to cause activation of the signal generator.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENTS

Figure 1:
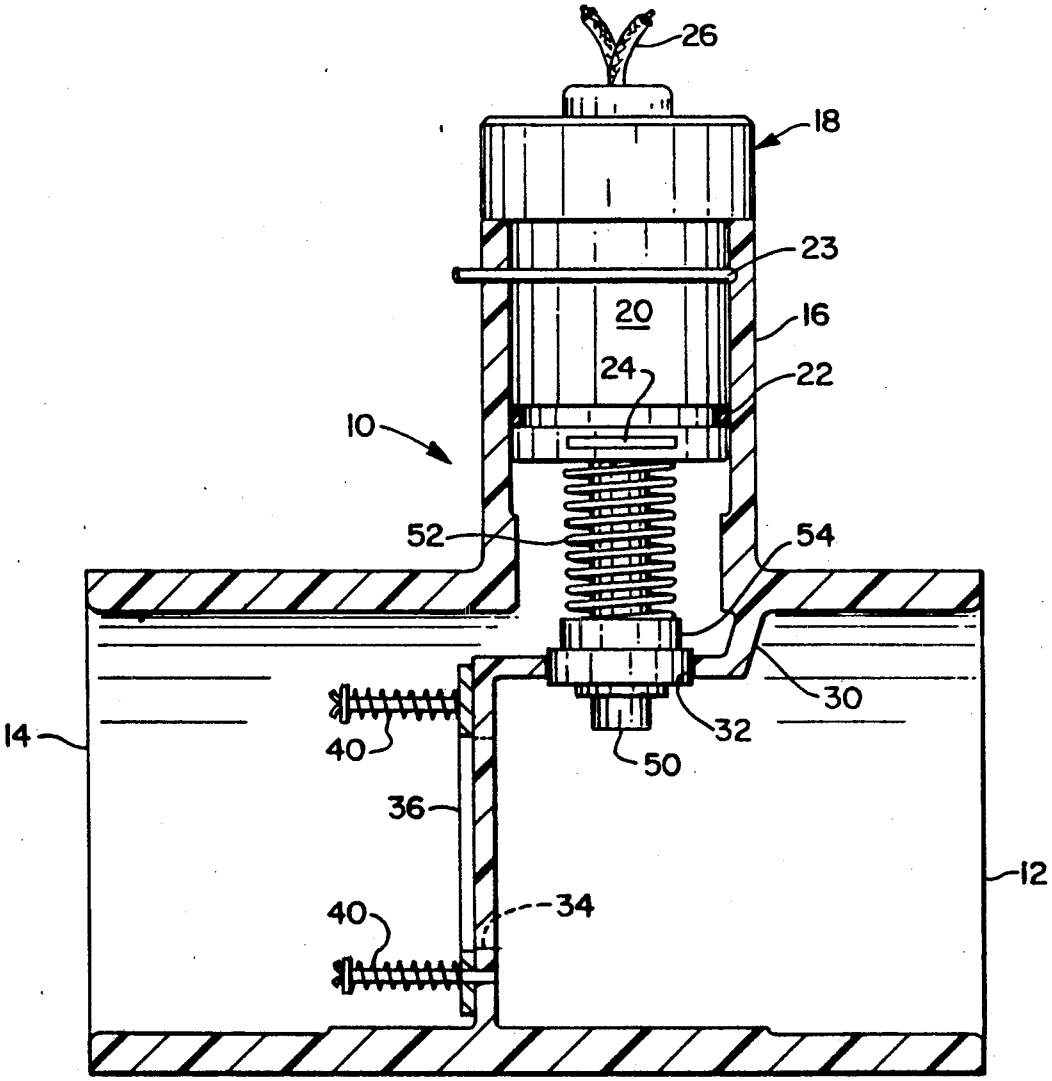
FIG. 1 is a schematic side elevation view, partly in section, of a flow responsive signal generator in accordance with a first embodiment of the invention, FIG. 1 depicting the device in the no-flow condition and being taken along lines I—I of FIG. 4.

With reference now to the drawings, a flow responsive device in accordance with the present invention comprises a housing, indicated generally at 10, which can be molded from a suitable plastic material such as polyvinyl chloride. Housing 10 defines a flow path, between an inlet port 12 and an outlet port 14, for the fluid of interest. In the disclosed embodiments, the ports 12 and 14 are coaxial. Housing 10 also has an extension 16 which is capped by a bonnet assembly 18. A solid body portion 20 of the bonnet assembly 18 is received in extension 16 and a fluid-tight seal between the bonnet assembly body portion 20 and housing 10 is provided by an O-ring seal 22.

The bonnet assembly 18 is captured in housing extension 16 by a locking wire 23. The tubular extension 16 of housing 10 is provided with an internal circumferential groove, and the body portion 20 of bonded assembly 18 is provided with a matching groove in its exterior surface. These grooves, when in registration, define an annular receiver for locking wire 23. The locking wire is inserted into the receiver via a hole provided through housing extension 16. The locking wire 23 has a diameter which is complimentary to that of the annular receiver. Wire 23 may be longer than the annular receiver so that it may be removed by gripping a "tail". Alternatively, disassembly can be presented by using a shorter locking wire which is fully inserted into the annular receiver.

The body portion 20 of the bonnet assembly 18 carries a magnetic field responsive signal generator, for example a reed switch, which will be located adjacent the inwardly disposed end of body portion 20 of bonnet assembly 18 and be encapsulated therein. In the disclosed embodiment, a reed switch has been indicated schematically at 24. The electrical leads from the contacts of switch 24 are indicated at 26 and extend through the body portion 20 of the bonnet assembly 18.

Figure 2:
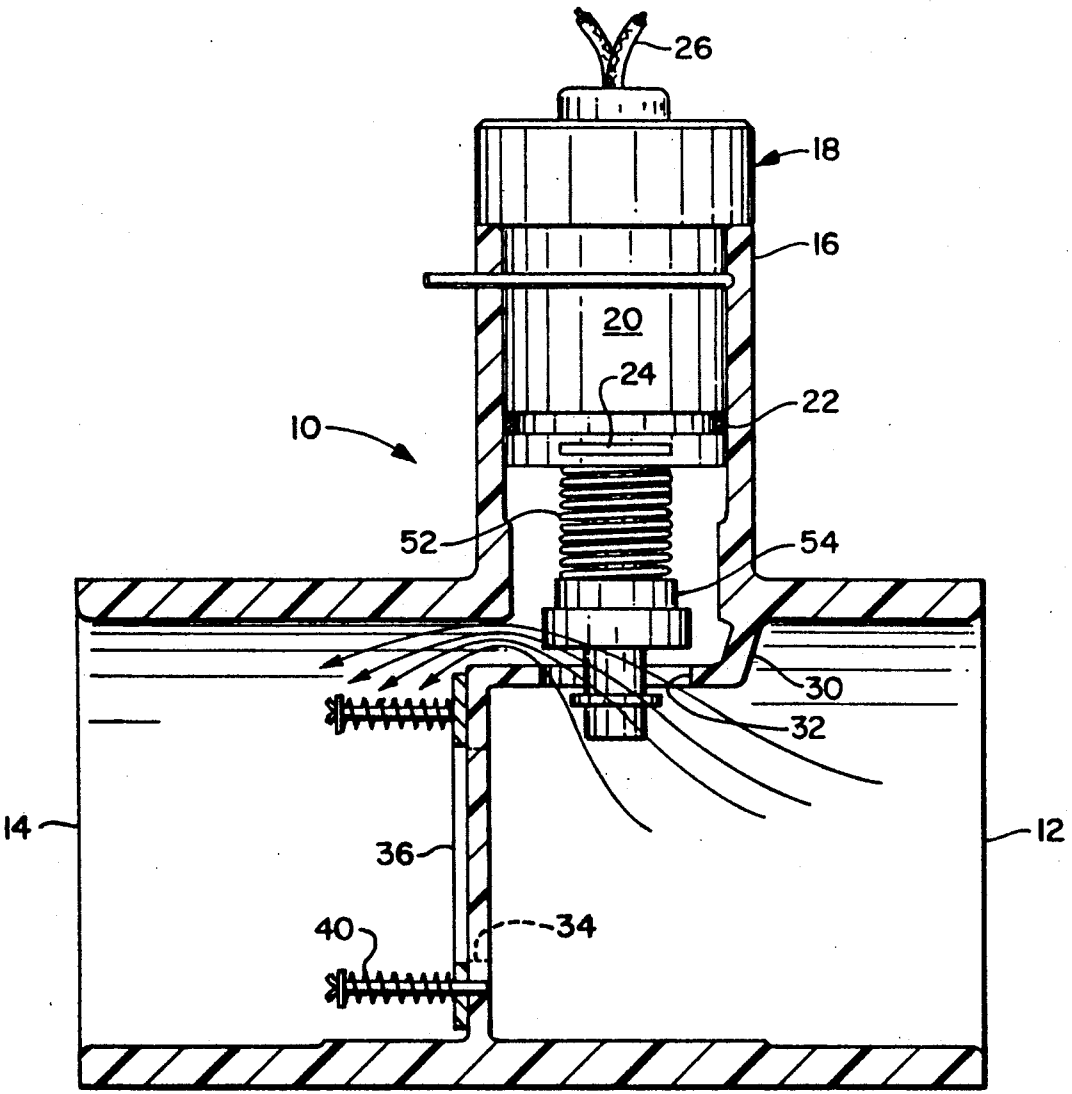
FIG. 2 is a view similar to FIG. 1 showing the device in the condition where the minimum flow setpoint has been satisfied.
Figure 3:
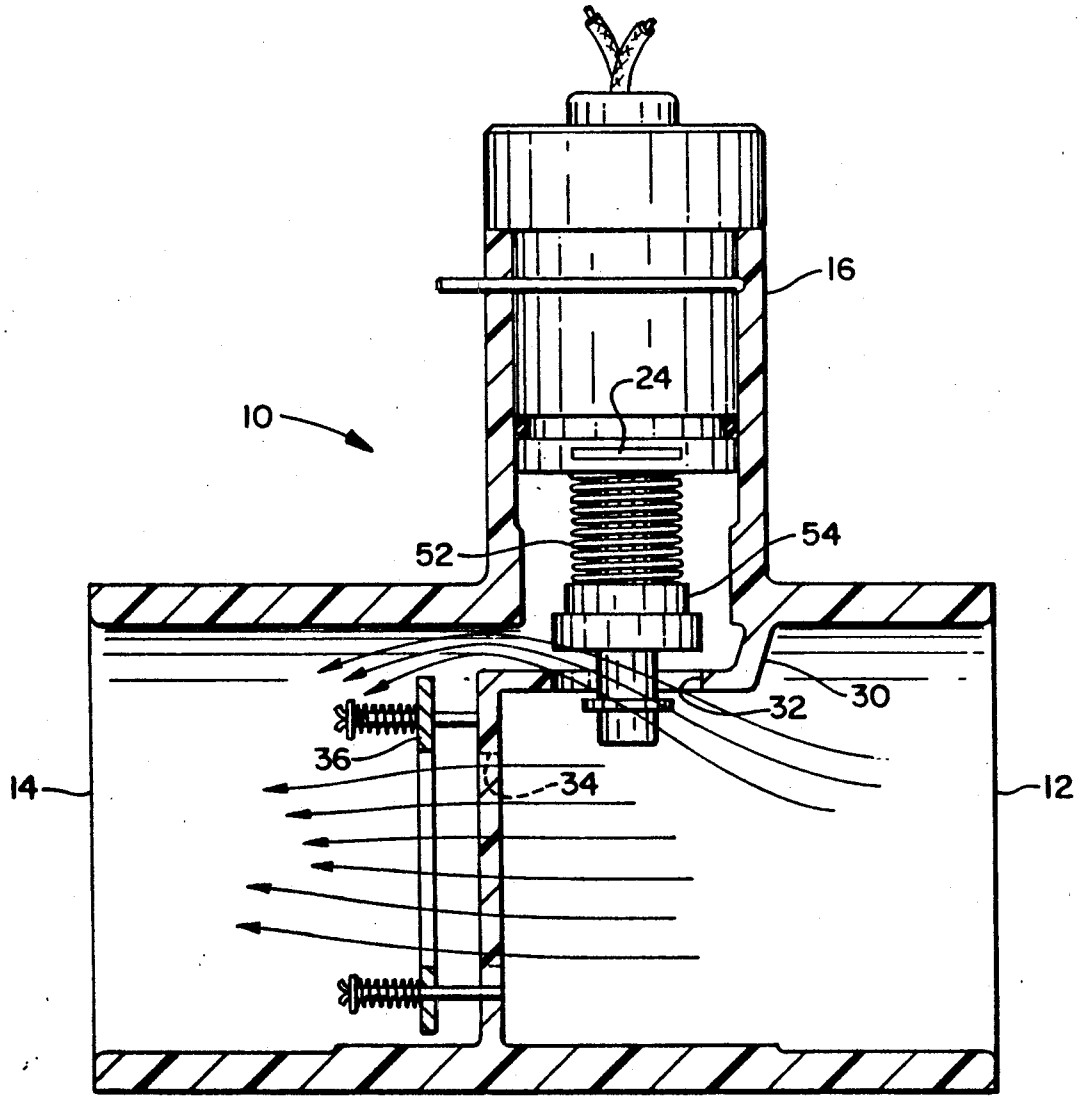
FIG. 3 is a view similar to FIGS. 1 and 2 depicting the device in the condition where the flow rate has exceeded the setpoint value causing the bypass flow path to open.
Figure 5:
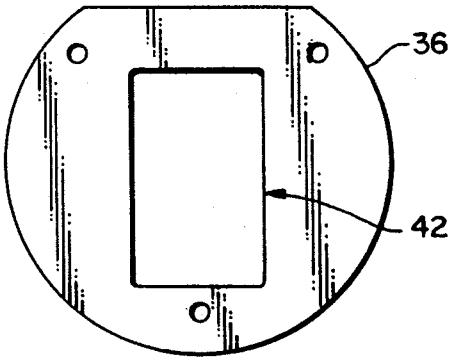
FIG. 5 is a plan view of the bypass valve member of the apparatus of FIGS. 1–3.
Figure 4:
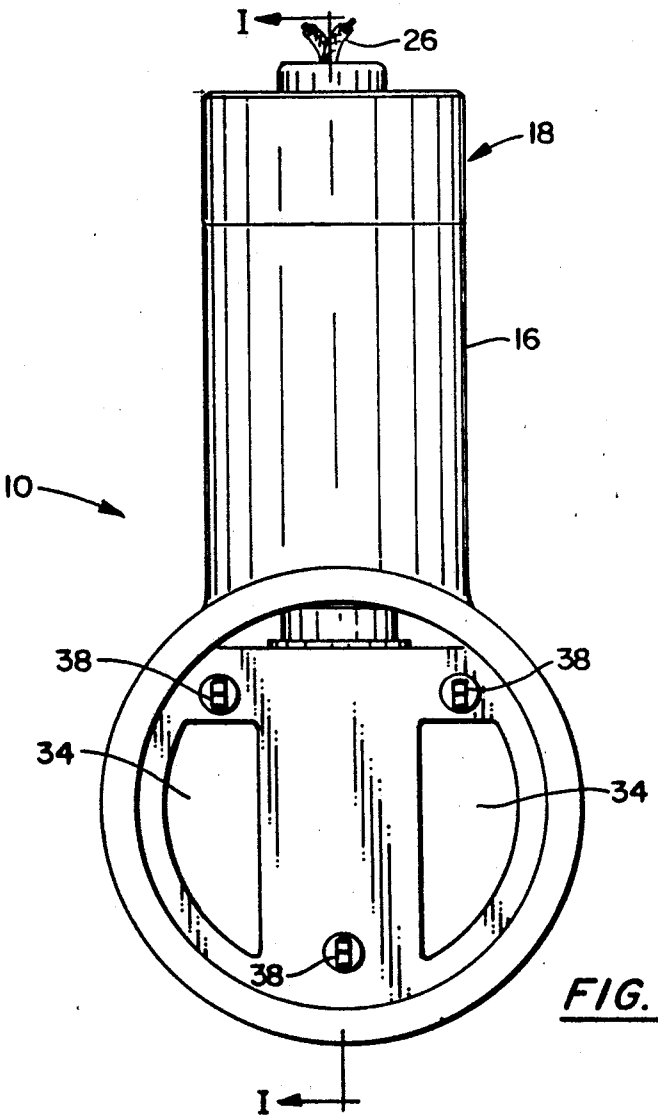
FIG. 4 is a front view of the apparatus of FIGS. 1–3 with the valve member which controls the bypass flow path removed.

The housing 10 is provided with an integral web member 30 which bridges the flow path between inlet port 12 and outlet port 14. The web member 30 defines a first port or seat 32 which is part of the normal flow path of the fluid being monitored. The web member 30 also defines, as may be seen from FIG. 4, a second seat which includes a further pair of flow ports 34. Ports 34, in the manner to be described below, define a bypass flow path. The bypass ports 34, in the embodiment of FIGS. 1-5, are normally closed by a valve member or clapper 36 which is mounted from the web 30 by means of a plurality of posts 38 as shown. The clapper 36 is biased toward the closed position by springs 40 which are received on posts 38. When the pressure differential across the clapper 36 is sufficiently great to generate a force which will cause compression of the springs 40, the bypass ports will be opened and a portion of the fluid flowing between the inlet and outlet ports of housing 1 will pass through the bypass ports 34 and through a port 42 provided in the clapper. Clapper 36 is provided with port 42, rather than merely permitting the bypass flow to pass about the perimeter of the clapper, in the interest of minimizing turbulence. The open condition of the bypass flow path is depicted in FIG. 3.

A shuttle member 50 is resiliently mounted so as to normally be positioned against the seat 32 in web member 30 as shown in FIG. 1. Shuttle 50 will be supported from the bonnet assembly 18 by means of a spring 52 and is capable of moving in the vertical direction as the flow responsive device is depicted in FIGS. 1-3. Suitable guide means, not shown in the interest of facilitating understanding of the invention, will be provided to ensure that the movement of the shuttle is along a path which is coaxial with the seat 32. The shuttle 50 will support, on the side thereof which faces the field responsive signal generator 24, a magnetic field generator which, in the disclosed embodiments, comprises a ring-shaped magnet 54. Accordingly, as the shuttle moves toward and away from the bonnet assembly, the magnet will approach and recede from the field responsive device 24. With the shuttle in the position shown in FIG. 1, the field responsive device 24 will be in a first state. The state of the device 24 will be switched when the shuttle reaches the position depicted in FIG. 2. Obviously, should the flow through the device subsequently diminish, for example in response to a back pressure at the outlet port 14, the shuttle will move back toward the port 32, and the field responsive device 24 will return to its initial state thus generating a control signal which may be employed to cause the flow to be interrupted at a point upstream of the inlet port 12.

In use, the shuttle and magnet are displaced by a calibrated flow rate. Should the flow rate exceed the calibrated rate, the shuttle will be further displaced and, if the flow path defined by the sensor is nevertheless unduly restricted, the pressure drop across the web and shuttle will increase to a sufficiently high level as to cause the clapper to travel against its biasing springs and thereby open the bypass ports. The bypass flow path is sized such that the opening of the bypass ports will not divert sufficient flow from the main flow path so as to cause the shuttle to move to a point where the signal generator 24 changes state. This arrangement, i.e., the employment of a bypass flow path which is enabled under very high flow conditions, permits the device to have a low flow setpoint, as would customarily be used in a small conduit, and nevertheless be used in a large diameter conduit and allow for high maximum flows. Also, since the majority of the flow will pass through the bypass ports during the bypass mode, the chances of the device being contaminated by the collection of particulate matter are greatly diminished.

Figure 7:
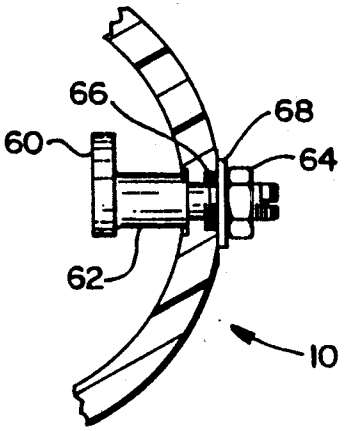
FIG. 7 is a partial view, taken transversely relative to FIG. 6, showing the control mechanism of the FIG. 6 embodiment.
Figure 6:
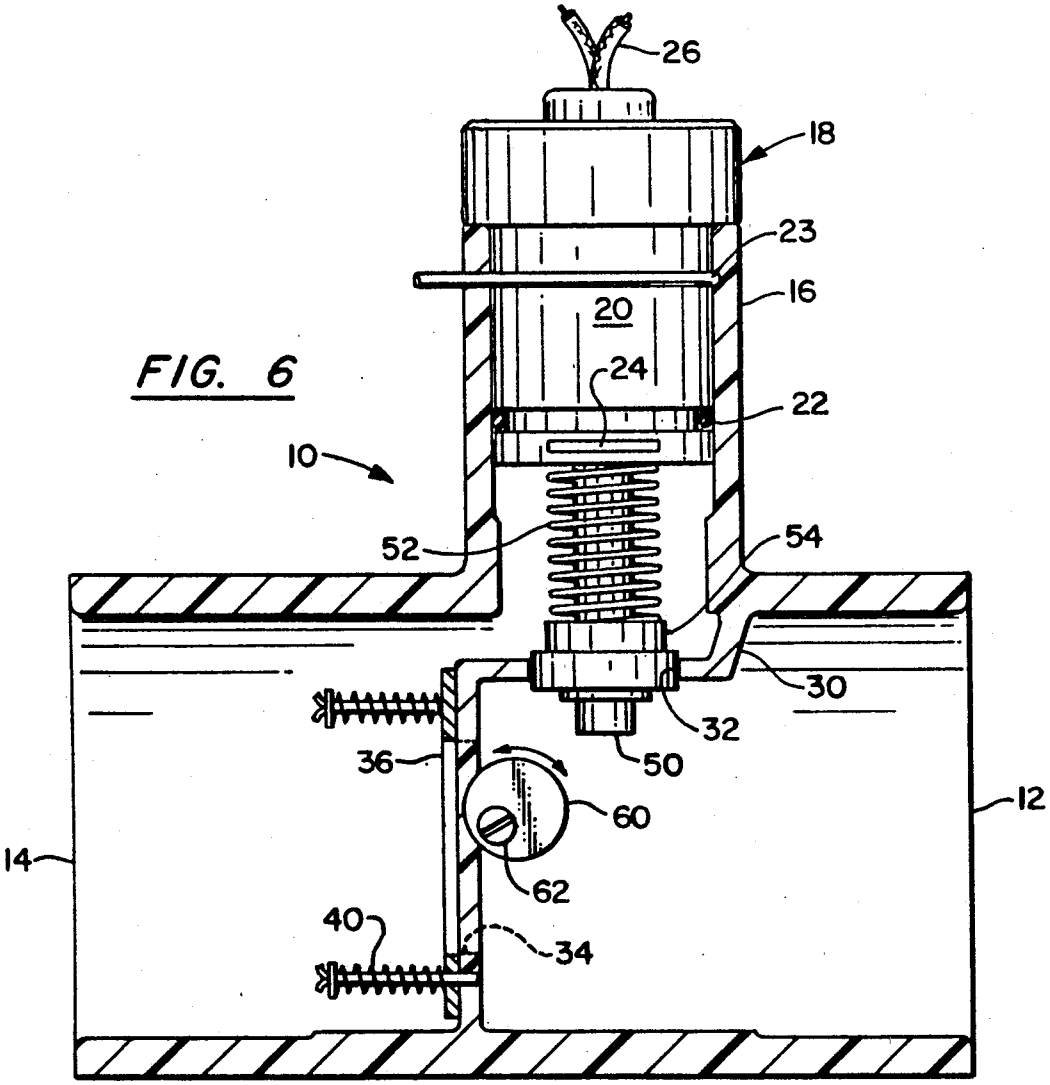
FIG. 6 is a view similar to FIG. 1 showing a modified form of the device, the apparatus of FIG. 6 having a field adjustable bypass flow path.

Field adjustment of the setpoint of a signal generator in accordance with the invention may be accomplished by utilization of the modification depicted in FIGS. 6 and 7. The embodiment of FIGS. 6 and 7 is, with the exception to be described below, identical to the above-discussed embodiment of FIGS. 1-5. The exception resides in the addition of an externally operable control member which can be employed to move the clapper 36 against the bias of springs 40 to thereby define a normally open bypass flow path of preselected area. The provision of a bypass flow path under normal flow conditions will change the set point of the device. In the disclosed embodiment, the control mechanism comprises an eccentric cam 60 which is mounted on a rotatable shaft 62. Shaft 62 extends through housing 10 and is provided, at the exterior side of the housing, with a locking nut 64. Leakage of fluid from inside of housing 10 about the rotatable shaft 62 is prevented by means of an O-ring seal 66, the seal being captured in a groove provided therefore by means of a washer 68 which is contacted by locking nut 64.

In FIG. 6, the eccentric 60 is not in contact with the clapper 36, and thus there will initially be no bypass flow. In order to permit bypass flow under normal operating conditions, and thus to raise the setpoint of the device, the lock nut 64 is loosened and a screwdriver inserted into a slot provided in the outwardly disposed end of shaft 62. The shaft may then be rotated to a position commensurate with cam 60 urging clapper 36 a predetermined distance away from its seat against the web 30. When the desired bypass flow area has been established, commensurate with the required setpoint, the locking nut 64 is re-tightened. As should be obvious, the device may be calibrated and appropriate means provided on the exterior of housing 10 so that the rotational position of the shaft 62 will be related to a predetermined setpoint.

While the present invention has been described in connection with what is presently considered to be the most practical and preferred embodiments, it is to be understood that the invention is not limited to the disclosed embodiments, but rather, is intended to cover various modifications and equivalent arrangements included within a spirit and scope of the appended claims.

What is claimed is:

1. A flow switch comprising:

a housing, said housing having an inlet port and an outlet port, said housing defining a conduit for the flow of fluid between said ports;

web means positioned in said housing and bridging said conduit, said web means having at least first and second openings which respectively define primary and bypass paths for the flow of fluid between said ports, said openings each having an axis;

shuttle means in said housing and cooperating with said web means first opening to control fluid flow through said first opening, said shuttle means being supported for generally reciprocal motion in the direction of the axis of said first opening, the position of said shuttle means being a function of the rate of flow of fluid through said first opening;

means mounted on said housing for generating an electrical signal commensurate with a predetermined position of said shuttle means, said signal generating means being responsive to the proximity of said shuttle means; and pressure responsive valve means mounted in said housing and cooperating with said web means second opening to control fluid flow through said second opening, said valve means including a movable valve member and means resiliently biasing said valve member towards said web means, said valve means moving independently of said shuttle means.

2. The apparatus of claim 1 wherein said shuttle means includes a magnetic field generator and wherein said signal generating means is a device responsive to a magnetic field.

3. The apparatus of claim 1 wherein said housing includes an extension, the reciprocal motion of said shuttle means is toward and away from said extension, and said signal generating means is mounted in said extension.

4. The apparatus of claim 3 wherein said extension has an axis which is generally coaxial with the axis of said first opening.

5. The apparatus of claim 4 wherein said shuttle means includes a magnetic field generator and wherein said signal generating means includes a device responsive to a magnetic field.

6. The apparatus of claim 1 wherein the axes of said web means second opening and said inlet and outlet ports are generally parallel and the axis of said first opening is not parallel to the axis of said second opening.

7. The apparatus of claim 6 wherein said housing has an extension, said extension has an axis which is aligned with the axis of said first opening, and said signal generating means is positioned in said housing extension.

8. The apparatus of claim 7 wherein said housing extension is of tubular construction and communicates with said housing defined conduit, said apparatus further comprising:

means for capturing said signal generator means in said tubular extension, said capturing means including:

a groove on the inside of said tubular extension;

a groove on the exterior of said signal generator means; and means for engaging said grooves when said grooves are in registration with one another, said groove engaging means having a diameter which exceeds the depth of the deepest one of said grooves.

9. The apparatus of claim 7 wherein said apparatus further comprises:

first seal means disposed between said signal generating means and said housing extension for preventing leakage of fluid from said housing about said signal generating means.

10. The apparatus of claim 8 wherein said apparatus further comprises:

first seal means disposed between said signal generating means and said housing extension for preventing leakage of fluid from said housing about said signal generating means.

11. The apparatus of claim 10 wherein said grooves in said housing tubular extension and signal generating means are circumferential grooves and said groove engaging means comprises an elongated member which may be inserted into said grooves through an aperture in said extension when said grooves are in registration, said aperture being in alignment with said housing groove on said extension.

12. The apparatus of claim 1 further comprising:

means for mechanically adjusting the position of said valve means movable valve member relative to said web means, said adjusting means defining a minimum bypass flow path area when there is no fluid flowing through said housing.

13. The apparatus of claim 12 wherein said valve member adjusting means comprises:

rotatable cam means, said cam means being located to contact said valve member and to position said valve member against the force of said resilient biasing means; and means for rotating said cam means from the exterior of said housing, said rotating means including a shaft which extends through said housing.

14. The apparatus of claim 13 wherein said shuttle means includes a permanent magnet and said signal generating means is a device response to a magnetic field.

15. The apparatus of claim 14 wherein said housing includes an extension, the reciprocal motion of said shuttle means is toward and away from said extension, and said signal generating means is mounted in said extension.

16. The apparatus of claim 8 wherein the reciprocal motion of said shuttle means is in the direction of said tubular extension and wherein said shuttle means includes a permanent magnet and said signal generating means is a device responsive to a magnetic field.

* * * * *